US006916193B2

(12) United States Patent
Varreng et al.

(10) Patent No.: US 6,916,193 B2
(45) Date of Patent: Jul. 12, 2005

(54) SUBSEA CONNECTOR

(75) Inventors: Jan Sverre Varreng, Oslo (NO); Oyvind Iversen, Ski (NO)

(73) Assignee: Nexans (FR)

( * ) Notice: Subject to any disclaimer, the term of this patent is extended or adjusted under 35 U.S.C. 154(b) by 0 days.

(21) Appl. No.: 10/616,485

(22) Filed: Jul. 8, 2003

(65) Prior Publication Data

US 2004/0097131 A1 May 20, 2004

(30) Foreign Application Priority Data

Jul. 11, 2002 (NO) ..... 023335

(51) Int. Cl.[7] ..... H01R 4/60
(52) U.S. Cl. ..... 439/201
(58) Field of Search ..... 439/201, 199, 439/205, 271

(56) References Cited

U.S. PATENT DOCUMENTS 2,619,515 A * 11/1952 Doane ..... 439/274
3,522,576 A * 8/1970 Cairns ..... 439/201
3,571,783 A * 3/1971 Lusk ..... 439/201
4,192,569 A * 3/1980 Mucci ..... 439/204
4,373,767 A * 2/1983 Cairns ..... 439/275
5,899,765 A * 5/1999 Niekrasz et al. ..... 439/201
5,900,585 A * 5/1999 Winfield et al. ..... 174/74 R

* cited by examiner

*Primary Examiner*—Gary Paumen
(74) *Attorney, Agent, or Firm*—Sofer & Haroun, LLP

(57) ABSTRACT

The present invention relates to the field of subsea connectors allowing in situ repair of damaged subsea electrical cables used for heating subsea pipelines. Said connector (18) comprises electrical connection means (1), insulating means (5) surrounding said electrical connection means (1) and sealing means (11, 12) for preventing surrounding liquid such as sea water from coming into contact with said electrical connection means (1) in order to ensure water-tightness. Said insulating means (5) are made of a wall disposed around said electrical connection means (1) so as to define a chamber (19) suitable for receiving at least one electrical cable end (20).

10 Claims, 1 Drawing Sheet

SUBSEA CONNECTOR

The present invention relates to the field of subsea connectors and more particularly but not limitatively to such connectors for subsea connection as the connectors allowing in situ repair of damaged subsea electrical cables used for heating subsea pipelines.

It is well known to provide heating cable systems for the transfer of electrical power to production pipelines lying on the seabed, for example to prevent organic residues deposition on the internal walls of the pipelines, particularly for viscous fluids transported in the pipe. The functioning of such a heating system relies on the cables used for heating, that must be protected from damages caused for example by anchoring or fishing.

In case the heating cable is damaged, the damaged part must be cut away and a connector must be used to connect the resulting ends of the cable.

A known method in order to repair a damaged electrical subsea cable consists in cutting the cable, bringing the damaged cable ends to the surface, fitting a new cable length to said ends and lowering the jointed cable to the seabed. This solution is very costly and time consuming, especially when the water is deep.

A solution to this problem is disclosed in the document U.S. Pat. No. 4,192,569. This document describes a subsea connector allowing to joint the two ends of the damaged cable on the seabed without the need to bring the cable ends to the surface. To allow this in situ repair, the connector comprises a connection terminal within a chamber pre-filled with electrically insulating grease or compound and separated by a diaphragm. When the cable ends are inserted, the excess mass of insulating grease is allowed to escape through a release valve and the electrical insulation is obtained by the remaining grease. All the connections may be made by a diver or by a remote manipulator such as a remote operated vessel (ROV).

This solution raises some difficult problems because known insulating greases have lower dielectric strength than solids, or impregnated solids, and the thickness of the grease layer may not be stable; therefore, the insulating grease layer must be made rather thick in order to withstand a high voltage. Moreover, insulating grease must be retained in the connector and there is always a risk of grease leaking out which could raise a water penetration in the connector.

An object of the invention is to provide an electrical subsea connector allowing in situ connection of electrical cables without raising the above mentioned problems.

More precisely, the invention provides an electrical subsea connector comprising:

- electrical connection means
- insulating means surrounding said electrical connection means,
- sealing means for preventing liquid such as sea water from coming into contact with said electrical connection means in order to ensure watertightness, characterized in that said insulating means are made of a wall disposed around said electrical connection means so as to define a chamber suitable for receiving at least one electrical cable end.

Thus, by use of this connector, the electrical insulation is obtained by a solid wall belonging to the connector and not by a grease. This wall has a higher dielectric strength than grease so that it can withstand higher voltages. Moreover, the wall belongs to the connector and defines the chamber into which the cable ends will be pushed; therefore, there is no need to retain the insulating means in the connector in order to prevent a risk of leakage, as it is the case when using grease.

Advantageously, said sealing means for preventing surrounding liquid such as sea water from coming into contact with said electrical connection means comprise a sealing compound such as a grease.

Thus, the role of this pre-filled sealing compound is to keep water out before the cable entry.

Advantageously, said sealing means comprises an outer diaphragm closing said chamber.

Thus, this diaphragm allows keeping the sealing compound inside the connector before entry of the cable. It also allows wiping off water from the surface of the entering cable.

Advantageously, said wall is made of an elastical material for tightening said cable end.

Thus, when a cable end is pushed into the connector, the elastic wall stays in contact with the cable due to its elastic properties, so that watertightness is improved.

In one embodiment, said elastical material is typically an elastomeric material such as silicone rubber or ethylene propylene diene monomer (EPDM).

Furthermore, said connector comprises an inner semiconducting wall surrounded by said insulating means.

Advantageously, said connector comprises an outer semiconducting wall around said insulating means.

Therefore, inner and outer semiconducting walls act as electrostatic shields for the spliced cable.

In one embodiment, the interface between said outer semiconducting layer and said insulating means has a curved profile.

In this embodiment, the curved profile of the interface has the same stress relieving effect as a deflector in a stress relief cone in order to prevent electrical breakdown.

In a preferred embodiment, said connector comprises holes in order to press out a pre-filled sealing compound such as grease when said cable is pushed into said chamber.

Thus, when the cable is pushed into the connector, the compound will be pressed out of the connector through the holes.

Advantageously, said connector comprises wiping means.

It is indeed very important to ensure a complete sealing and a film of water on the surface of the cable is thus not tolerable. Wiping means are going to wipe off water from the surface of the entering cable.

Other characteristics and advantages of the invention will appear on reading the following description of embodiments of the invention, given by way of example and with reference to the accompanying drawings, in which:

In all these figures, elements which are common are given with the same reference numerals.

FIG. 1 shows a longitudinal cross-section of a connector 18 of the invention. This connector 18 is double-ended to connect two electrical cables together.

Figures 1, 2, 3:
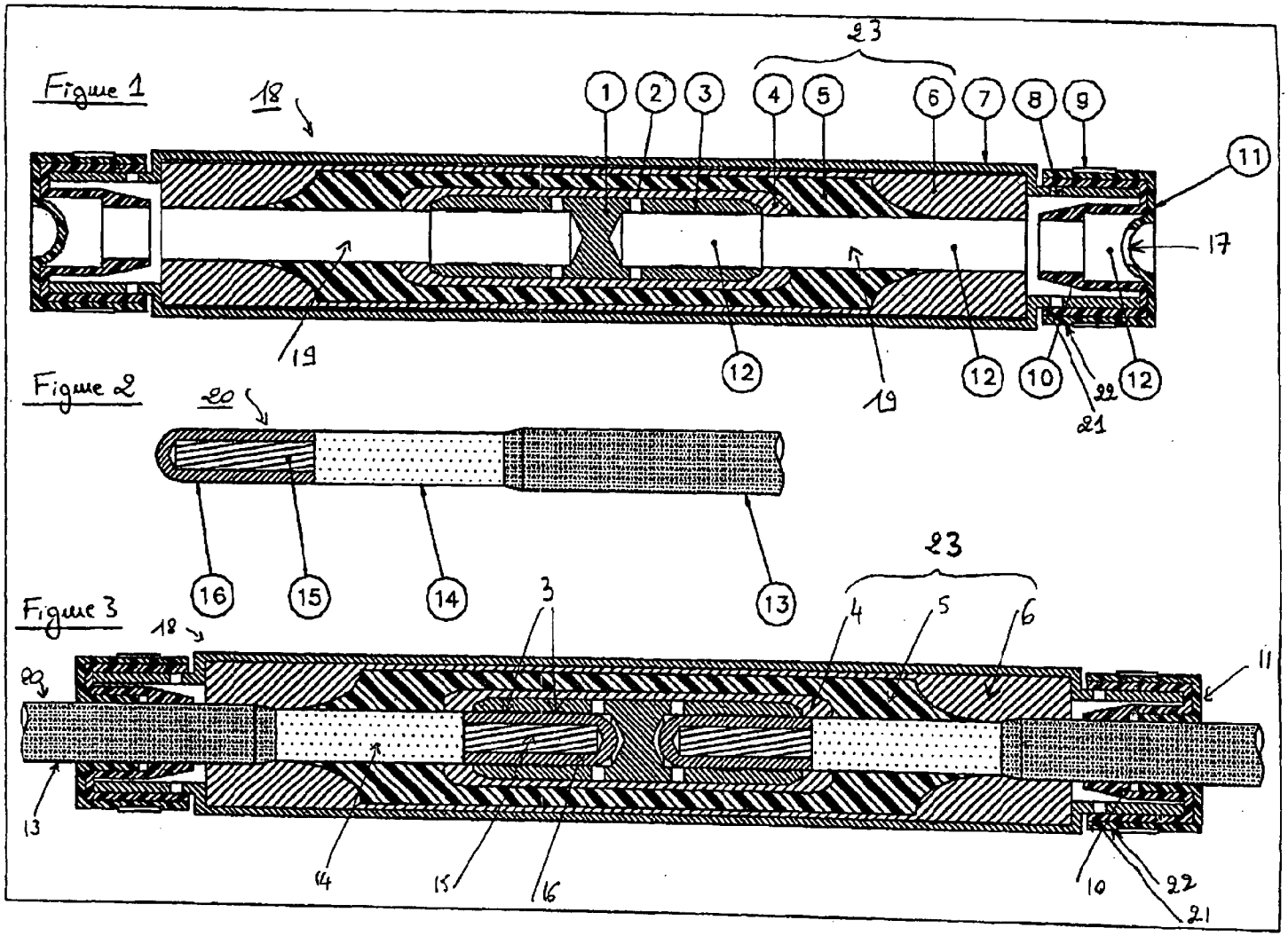
FIG. 1 shows a longitudinal cross-section of a connector of the invention.
FIG. 2 shows a longitudinal cross-section of a subsea electrical cable to be used within a connector of the invention.
FIG. 3 shows a longitudinal cross-section of a connector of the invention with two subsea electrical cable ends inserted into it.

The connector 18 comprises an outer metallic housing 7 containing a central copper connecting sleeve 1 acting as electrical connection means.

The connector 18 is substantially symmetrical about the central connecting sleeve 1 and includes two hollow chambers 19 with a substantially tubular shape extending longitudinally along the housing 7 on both sides of the central copper connecting sleeve 1. Each of the two chambers 19 enters into the copper connecting sleeve 1 and is surrounded, in a known manner, by two lamellar contact rings 3 in electrical contact with the copper connecting sleeve 1.

The copper connecting sleeve 1 is surrounded by a semiconducting wall 4. The copper connecting sleeve 1 is slightly loose into the interior formed by this semiconducting wall 4, but still there is always electrical contact between them.

For each of the chambers 19, two holes 2 passing through the central connecting sleeve 1 make a leadthrough between the chamber 19 and the semiconducting wall 4.

According to the invention, the semiconducting wall 4 is surrounded by an insulating wall 5 surrounded itself by a second semiconducting wall 6.

The second semiconducting wall 6 extends all along the two chambers 19 while the insulating wall 5 acting as insulating means and the first semiconducting wall 4 extend partially along the two chambers 19.

The interface between insulating wall 5 and semiconducting wall 6 has a curved profile in order to prevent electrical breakdown. The curved profile of the interface has the same stress relieving effect as a deflector in a stress relief cone.

Walls 4, 5 and 6 are moulded together in one single element 23 and are made of a same elastomeric material, typically ethylene propylene diene monomer (EPDM), crosslinked polyethylene (XLPE) or silicon rubber except that the material used for walls 4 and 6 is also doped, for example with carbon black.

The connector 18 is closed at its ends by two rubber diaphragms 11 acting as sealing means. Both rubber diaphragms 11 have a slit aperture 17.

Each of the rubber diaphragms 11 covers a rubber wiper 10 fitted into said rubber diaphragm 11. Each rubber wiper 10 is located between the output of the corresponding rubber diaphragm 11 and the input of one of the chambers 19. Rubber diaphragms 11 and rubber wipers 10 act as wiping means.

The casing 7 comprises holes 8 passing through the rubber wiper 10 and making a leadthrough between the interior and the exterior of the casing 7, said holes being obturated by two rubber layers 21 and 22, said rubber layers 21 and 22 being respectively the extremities of the rubber wiper 10 and the rubber diaphragm 11.

The rubber diaphragms 11 and the rubber wipers 10 are fixed to the housing 7 by clamps 9.

All the hollow parts, such as the interior of both chambers 19 or of the rubber wiper 10, are pre-filled with a compound 12 of high viscosity like grease, gel or oil, acting as sealing means and represented by all the white unhatched volume. The function of such a compound 12 is mainly to keep the water out of the connector 18. The rubber diaphragm 11 keeps said compound 12 inside the connector 18 before the entry of a cable.

FIG. 2 shows a longitudinal cross-section of a subsea electrical cable end to be used within a connector 18 of the invention.

Electrical cable end 20 comprises a central conductive core 15 and in succession and coaxially around said core 15: an inner semiconductive screen not shown, an insulation layer 14 and an outer semiconductive screen 13. Electrical cable end 20 is prepared for being inserted into connector 18 by stripping off the various layers as shown in FIG. 2. When such a subsea cable is damaged, it is necessary to bare the insulation layer 14 and the outer semiconductive screen 13 as represented in FIG. 2. A copper contact sleeve 16 is fitted onto the bare central conductive core 15 in order to ensure the electrical contact between the core 15 and the connector 18.

FIG. 3 shows a longitudinal cross-section of a connector 18 of the invention with two cable ends 20 as shown in FIG. 2 connected into said connector. The installation of one cable end 20 into the connector 18 is explained below.

Preferably, the outer diameter of the insulation layer 14 and of the copper contact sleeve 16 must be greater than the bore of the semiconductor wall 4 and the insulating wall 5. In the same way, the outer diameter of the outer semiconductive screen 13 must be greater than the bore of the semiconductor wall 6. Thus, said cable 20 will be tightened when entering into the connector 18, ensuring by this way a good insulation.

In a first step, the cable 20 is pushed through the aperture slit 17 of the rubber diaphragm 11 and through the rubber wiper 10; the compound 12 starts to be pressed out through the holes 8 by lifting the rubber layers 21 and 22 of the wiper 10 and the diaphragm 11, said layers 21 and 22 covering the holes 8. The rubber diaphragm 11 and the rubber wiper 10 wipe off the water from the entering cable 20.

In a second step, the cable 20 is pushed further into the chamber 19 and compound 12 is pressed out at the interface between the element 23 and the cable 20 and then through the holes 8.

In a third step, the cable 20 comes in its final position with the contact sleeve 16 of the bared conductive core 15 contacting the connecting sleeve 1 via the lamellar contact rings 3. Compound 12 is pressed out through the holes 2 and escapes at the interface between the sleeve 1 and the element 23. The outer semiconductive screen 13 is in contact with the second semiconducting wall 6; the insulation layer 14 is mainly in contact with the insulating wall 5 and the copper contact sleeve 16 is in contact with the lamellar contact rings 3 making an electrical contact between the core 15 and the copper connecting sleeve 1.

The elastomeric element 23 retracts tightly against the surface of the cable 20 ensuring at the same time the insulation and the electrostatic shielding of the cable 20. Most of the compound 12 is pushed out of the connector 18 through holes 8 but, since a thin film of compound 12 can remain at the interface when the cable 20 is installed, the dielectric properties of said compound 12 must be sufficiently good.

Naturally, the present invention is not limited to the examples and embodiments described and shown, and the invention can be the subject to numerous variants that are available to the person skilled in the art.

The connector has been described for instance as a double ended connector but it is also within the scope of the invention for the connector to be single ended for bulkhead mounting.

What is claimed is:

1. Electrical subsea connector comprising:

electrical connection means;

insulating means surrounding said electrical connection means;

sealing means for preventing surrounding liquid such as sea water from coming into contact with said electrical connection means in order to ensure watertightness, said sealing means having a sealing compound such as a grease; and an outer housing enclosing said electrical connection means, insulating means and sealing means, and extending along a longitudinal axis, wherein said insulating means formed of a solid and elastic molded insulation layer attached to and fixed with respect to said outer housing, said insulation layer being coaxial with said outer housing and being disposed around said electrical connection means so as to define a chamber suitable for receiving at least one electrical cable end, said insulation layer being coaxial with said chamber, where said chamber is dimensioned so that when a cable end is fully inserted into it, said cable end replaces substantially all said sealing compound and forming a tight fit between said insulation layer and the insulation of said cable end.

2. Electrical subsea connector according to claim 1 wherein said sealing means has an outer diaphragm closing said chamber.

3. Electrical subsea connector according to of claim 1 wherein said wall is made of an elastical material for tightening said cable end.

4. Electrical subsea connector according to claim 3 wherein said elastical material is an elastomeric material such as silicone rubber or ethylene propylene diene monomer.

5. Electrical subsea connector according to claim 1 wherein said connector has an inner semiconducting wall surrounded by said insulating means.

6. Electrical subsea connector according to claim 1 wherein said connector has an outer semiconducting wall around said insulating means.

7. Electrical subsea connector according to claim 6 wherein the interface between said outer semiconducting wall and said insulating means has a curved profile.

8. Electrical subsea connector according to claim 1 wherein said connector comprises holes in order to press out a prefilled sealing compound such as a grease when said cable is pushed into said chamber.

9. Electrical subsea connector according to claim 1 wherein said connector comprises wiping means.

10. Electrical subsea connector according to claim 1, wherein the inner diameter of said chamber is smaller than the outer diameter of said cable end so ass to ensure tightening of said cable end into said chamber.

* * * * *